United States Patent [19]

Dossekker

[11] Patent Number: 4,517,875

[45] Date of Patent: May 21, 1985

[54] REED MOUTHPIECE FOR MUSICAL WIND INSTRUMENT

[75] Inventor: Bruno Dossekker, Zurich, Switzerland

[73] Assignee: Sodecom SA, Switzerland

[21] Appl. No.: 584,537

[22] Filed: Feb. 28, 1984

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,525,430 | 2/1925 | Livingston | 84/383 R |
| 1,748,077 | 2/1930 | Packman et al. | 84/383 R |
| 2,496,749 | 2/1950 | Reddick | 84/383 R |

FOREIGN PATENT DOCUMENTS

| | | | |
|---|---|---|---|
| 89067 | 2/1896 | Fed. Rep. of Germany | 84/383 R |
| 2497987 | 7/1982 | France | 84/383 R |

*Primary Examiner*—Lawrence R. Franklin
*Attorney, Agent, or Firm*—Hauke and Patalidis

[57] ABSTRACT

A mouthpiece for a musical wind instrument. The mouthpiece has a casing, a reed and a reed attachment assembly mounted in the top of the casing. The reed attachment assembly has a support member pivotably connected to a frame. The foot of the reed is clamped against a plate portion of the pivotable support member such that the blade of the reed protrudes from the attachment assembly and extends above the top surface of the casing with the tip of the reed being disposed proximate the leading edge of the casing. Means are provided for adjusting the inclination of the plate of the pivotable support member relative to the frame wherein the distance between the tip of the reed and the leading edge of the mouthpiece casing can be varied by the adjustment means.

5 Claims, 4 Drawing Figures

FIG. 1
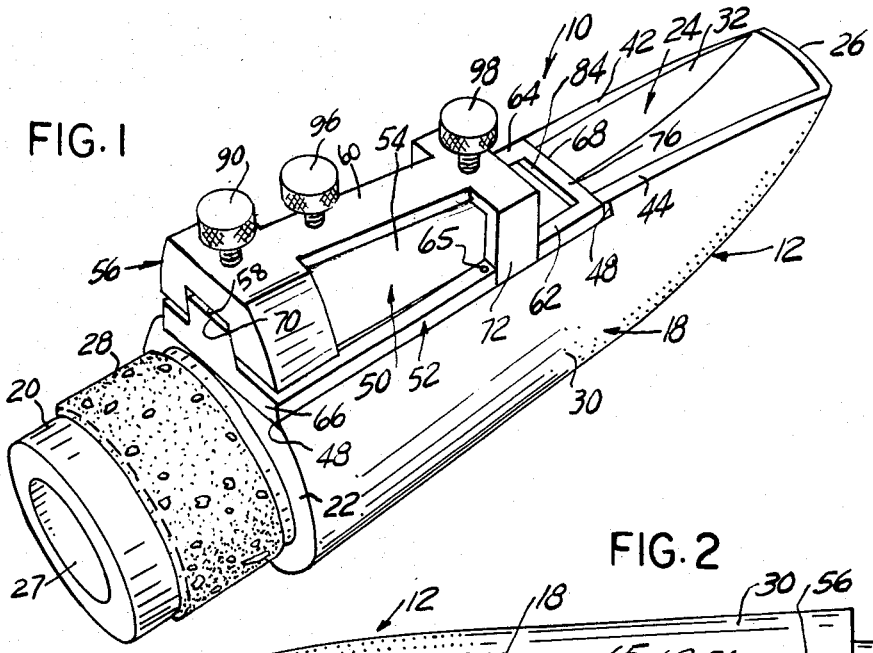
FIG. 2
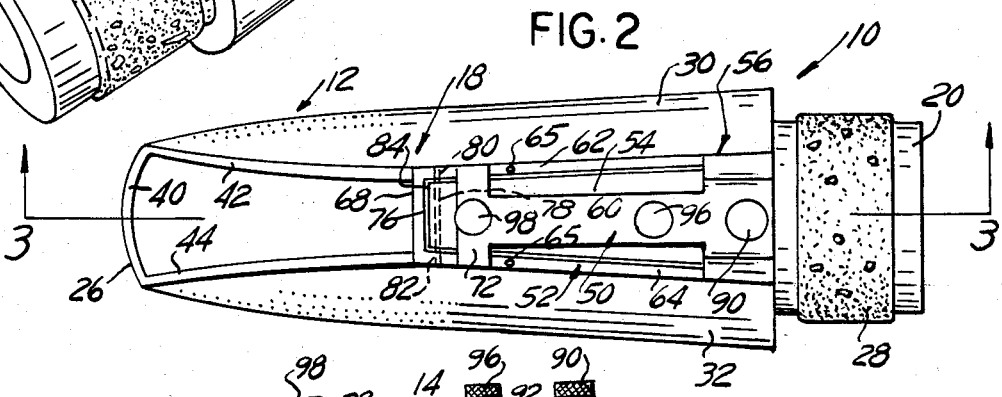
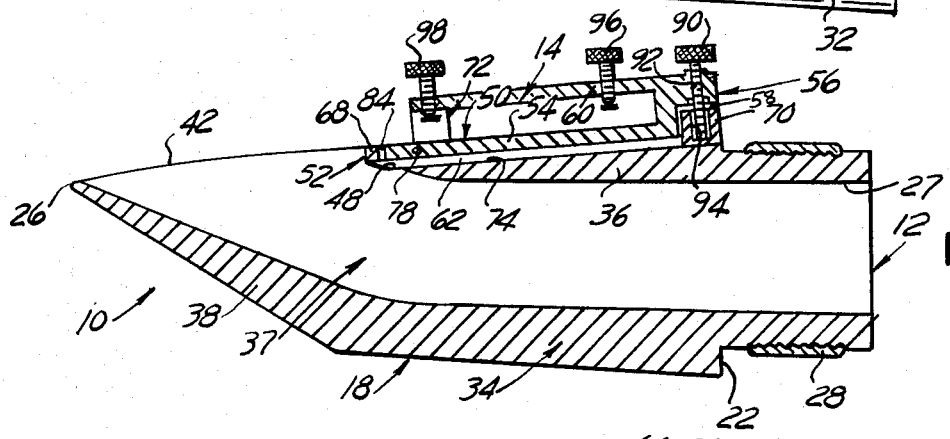
FIG. 3
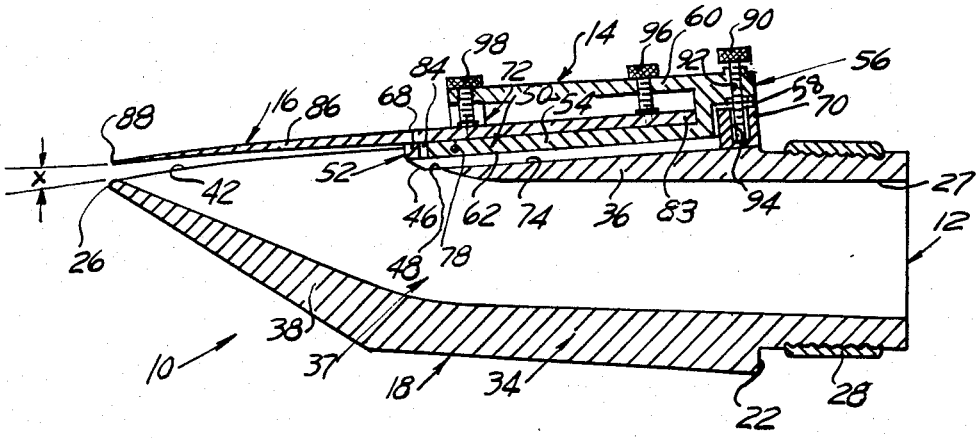
FIG. 4

REED MOUTHPIECE FOR MUSICAL WIND INSTRUMENT

BACKGROUND OF THE INVENTION

In conventional mouthpieces for musical wind instruments, such as clarinet mouthpieces, for example, the foot portion of a bamboo reed is affixed to a support surface in the mouthpiece casing by means of a ligature. The blade of the reed protrudes above the top of the mouthpiece casing with the tip of the reed blade disposed proximate the leading edge of the casing.

The width of the gap between the tip of the reed blade and the top surface of the leading edge of the mouthpiece casing is an important factor in determining the quality of sound produced by an instrument having a mouthpiece of the type described. Nonetheless, prior art mouthpieces have the disadvantage that the width of reed tip-casing edge gap is not adjustable. As a result, musicians are often forced to purchase different mouthpieces and must experiment for a long time before finding a mouthpiece with which they are comfortable.

Another disadvantage of conventional mouthpieces is the difficulty encountered by a user desiring to change a reed. Reeds have a relatively short life and must be frequently replaced. The ligatures which fasten the reed to the mouthpiece casing are inconvenient to remove and subject to breaking when doing so.

SUMMARY OF THE INVENTION

The present invention provides a mouthpiece for a musical wind instrument which overcomes the disadvantages of the prior art. More particularly, a mouthpiece according to the invention is provided with a reed attachment assembly mounted in the top of a mouthpiece casing. The reed attachment assembly comprises a support member pivotably connected to a frame. Convenient means are provided for removably clamping the foot of a reed to a portion of the pivotable support member. With the foot of the reed thus clamped, adjustment of the inclination of the support member varies the width of a gap between the tip of the reed blade and the top surface of the leading edge of the mouthpiece casing.

The many objects and advantages of the present invention will become apparent to those skilled in the art when the following description of the best mode contemplated for practicing the invention is read in conjunction with the accompanying drawing wherein like reference numerals refer to like elements and in which:

BRIEF DESCRIPTION OF THE DRAWINGS

FIG. 1 is a perspective view of an example of a reed attachment assembly mounted in the top of a mouthpiece casing;

FIG. 2 is a top plan view thereof;

FIG. 3 is a sectional view along line 3—3 of FIG. 2; and

FIG. 4 is a view similar to FIG. 3 with the additional aspect of a reed fastened in the reed attachment assembly of the mouthpiece casing.

DETAILED DESCRIPTION OF THE PREFERED EMBODIMENT

The drawing illustrates an example of a mouthpiece 10 for a musical wind instrument, such as a clarinet, comprising a mouthpiece casing 12, a reed attachment assembly 14 and a reed 16. The casing 12 of the mouthpiece 10, which is preferably formed as a single piece, has a beak-shaped configuration defined by an arcuate body portion 18 with a cylindrical portion 20 extending through and protruding from an end wall 22 of the body portion 18. The arcuate body portion 18 of the mouthpiece casing 12 has an air intake or blowhole 24 proximate its leading edge 26 and the protruding cylindrical portion 20 of the casing 12 has an axially-disposed air outlet or exhaust port 27 formed therethrough. In addition, the cylindrical portion 20 of the casing 12 is provided with a compressible retainer ring 28 fastened to its exterior periphery for frictionally holding the mouthpiece 10 in the barrel of a clarinet, not shown. The retainer ring 28 is well known, and may be made of any suitable material such as cork or elastomeric foam padding, for example.

Referring now to the arcuate body portion 18 of the mouthpiece casing 12 in greater detail, the body portion 18 comprises the end wall 22 and two curvilinear sidewalls 30, 32 formed integrally with a bottom wall 34 and a partial top wall 36. The bottom wall 34 and partial top wall 36 are also integral with the cylindrical portion 20 of the casing 12 such that a continuous air channel or passageway 37 is formed between the walls 34, 36 for connecting the blowhole 24 with the air outlet 27. The bottom wall 34 of the body portion 18 has an upwardly directed forward end 38, the top surface 40 of which connects the respective top surfaces 42, 44 of the sidewalls 30, 32 at the leading edge 26 of the casing 12. The partial top wall 36 connects the sidewalls 30, 32 and protrudes from the end wall 22 of the body portion 18 to a point substantially midway between the end wall 22 and leading edge 26 of the casing 12. The air intake or blowhole 24 is defined by an opening or gap between the sidewalls 30, 32 of the casing extending from the leading edge 46 of the top wall 36 to the top surface 40 of the forward end 38 of the bottom wall 34. The top surfaces 42, 44 of the sidewalls 30, 32 are provided with a downward bevel along the blowhole 24.

A cut out portion or recess 48 is formed in the top edge of each sidewall 30, 32 from the end wall 22 of the body portion 18 to the beveled top surfaces 42, 44 of the sidewalls 30, 32 along the blowhole 24. These recesses 48 are provided for mounting the reed attachment assembly 14 at the top of the body portion 18 of the casing 12 between the sidewalls 30, 32 thereof, as more fully explained hereafter.

The reed attachment assembly 14 comprises a support member 50 and a four-sided frame 52. More particularly, the support member 50 of the attachment assembly 14 is generally U-shaped in cross-section, comprising a plate 54 and a rearward bracket or stirrup 56 protruding at a right angle proximate an end of the plate 54. The rearward stirrup 56 is relatively wide and U-shaped, having a centrally disposed, cut-out portion 58 extending through one end thereof. A relatively narrow bridge portion 60 protrudes from the top of the rearward stirrup 56, proximate the middle thereof.

As best seen at FIGS. 1 and 2, the frame 52 of the reed attachment assembly 14 has two longitudinal side members 62, 64, two cross-members 66, 68 connecting the side members 62, 64 at the respective ends thereof, and a boss or block 70 formed at the top of the rearward cross-member 66 proximate the middle thereof. The block 70 of the frame 52 is slidably engageable in the cut-out portion 58 of the rearward support member stirrup 56 and the forward stirrup 72 of the support member 50 joins the side members 62, 64 of the frame 52 proximate cross-member 68.

The frame 52 is configured to be placed across the upper surface 74 of the top wall 36 of the body portion 18 of the mouthpiece casing 12, FIGS. 3 and 4, with the side members 62, 64 of the frame 52 snugly fitting into the recesses 48 of the body portion sidewalls 30, 32. Fasteners 65, such as snap rivets for example, are preferably passed through each side member 62, 64 of the frame 52 and into the recesses 48 for holding the frame 52 in a fixed position and each member 62–68 of the frame 52 is preferably provided with a height such that the top surface 76 of the frame 52 continues without interruption or step to the beveled top surfaces 42, 44 of the sidewalls 30, 32 along the blowhole 24.

The plate 54 of the support member 50 is provided with dimensions slightly smaller than those of the interior of the frame 52 to permit the plate 54 to pivot within the frame. As shown, the plate 54 of the support member 50 is pivotably connected to the frame proximate cross-member 68 by means of a transverse pin 78, FIG. 2. The pin 78 is fitted through a transverse bore in the frontal portion of the plate 54 of the support member 50, the respective ends 80, 82 of the pin 78 projecting into aligned apertures or slots in the side members 62, 64 of the frame 52. It is apparent that for the plate 54 to be pivotable relative to the frame 52, a small space 84 should be provided between the forward edge of the plate 54 and cross-member 68.

The reed attachment assembly 14 further comprises means for adjusting the inclination of the plate 54 of the support member 50 relative to the frame 52 and means for clamping the foot 83 of the reed 16 to the pivotable plate 54 of the support member 50. The clamping means is arranged such that the blade 86 of the reed, the foot 83 of which is clamped to the plate 54 of the support member 50, protrudes from the attachment assembly 14 and extends over the top of the mouthpiece casing 12, with the tip 88 of the reed 16 being disposed proximate the leading edge 26 of the casing 12. The adjusting means permit to vary the distance between the tip 88 of the reed 16 and the leading edge 26 of the casing 12, or more exactly the distance between the tip 88 and surface 40 of the upwardly directed frontal portion 38 of the casing bottom wall 34, shown as "X" at FIG. 4, by adjusting the inclination of the support member plate 54 relative to the frame 52.

As one example of means for adjusting the inclination of the support member plate 54 relative to the frame 52, an adjusting screw 90 is fitted through a transverse bore 92 in rearward stirrup 56. The adjusting screw 90 continues into an aligned transverse bore 94 in block 70. It can be seen, therefore, that turning of the adjusting screw 90 will lower or raise the plate 54 of the support member 50 by lifting or dropping stirrup 56. As an example of clamping means, two screws 96, 98 are fitted transversely through bores in the top of the stirrup 72 and bridge portion 60 of the support member 50. Each screw 96, 98 preferably has an annular plate or pad 99 at the bottom thereof. As shown at FIGS. 3 and 4, to hold the reed 16 in the attachment assembly 14, the foot 83 of the reed 16 is inserted over the plate 54 of the support member 50 and the screws 96, 98 are threaded down, such that the pads 99 are pressed against the top of the reed foot 84, FIG. 4.

As mentioned, a reed attachment assembly 14 according to the invention permits a variety of reeds 16 to be used with a single mouthpiece 10 since the convenient clamping means permits the reed 16 to be easily released and removed and a new reed inserted. Moreover, the distance "X" between the tip 88 of the reed 16 and the leading edge 26 of the mouthpiece casing 12 is easily adjusted by screw 90, thereby permitting the tonality of the musical wind instrument with which the mouthpiece 10 is used to be varied.

Although the mouthpiece casing 12 shown in the drawing is typical of a clarinet mouthpiece, it will be appreciated that the invention is applicable to other instruments having a vibrating reed, such as saxophones.

Having thus described the present invention by way of examples of structure well adapted to accomplish the purpose of the invention, modification whereof will be apparent to those skilled in the art, what is claimed as new is as follows:

1. A mouthpiece for musical wind instrument comprising a casing, a reed and a reed attachment assembly mounted at the top of said casing, said reed attachment assembly comprising a support member pivotably connected to a frame, said frame being fixed to said casing and said frame having a forward stirrup integrally protruding at a right angle proximate an end of said frame, said support member being provided with a plate disposed within said frame, a rearward stirrup integrally protruding at a right angle proximate an end of said plate, a relatively narrow bridge portion integrally protruding from the top of said rearward stirrup proximate the middle thereof, said bridge portion being integrally connected to said forward stirrup protruding from said frame, said attachment assembly further comprising means for adjusting the inclination of said plate of said support member relative to said frame, and means for clamping the foot of said reed to said plate of said pivotable support member such that the blade of said reed protrudes from said attachment assembly and extends over the top of said casing with the tip of said reed being disposed proximate the leading edge of said casing, wherein the distance between said tip of said reed and said leading edge of said casing is variable by said means for adjusting said support plate.

2. The mouthpiece of claim 1 wherein said support member is pivotably connected to said frame proximate said forward stirrup.

3. The mouthpiece of claim 2 wherein said frame is disposed in a cut-out portion of said mouthpiece casing, and said support member is provided with a transverse pin, the respective ends of said transverse pin projecting into side members of said frame.

4. The mouthpiece of claim 1 wherein said means for clamping the foot of said reed to said support member comprises a screw disposed above said plate of said support member, said screw having a pad for applying said foot of said reed against said plate.

5. The mouthpiece of claim 1 wherein said means for adjusting the inclination of said plate of said support member is an adjusting screw fitted through a transverse bore in said rearward stirrup and into a transverse bore in a rear portion of said frame.

* * * * *